US006398222B1

(12) United States Patent
Everett

(10) Patent No.: US 6,398,222 B1
(45) Date of Patent: Jun. 4, 2002

(54) BOARD GAME

(76) Inventor: Elaine Everett, 16 Northfield Terrace, Church Fenton, Tadcaster, North Yorkshire (GB), LS24 9RQ ( * ) Notice: Subject to any disclaimer, the term of this patent is extended or adjusted under 35 U.S.C. 154(b) by 0 days.

(21) Appl. No.: 09/673,659

(22) PCT Filed: May 6, 1999

(86) PCT No.: PCT/GB99/01409

§ 371 (c)(1),
(2), (4) Date: Dec. 20, 2000

(87) PCT Pub. No.: WO99/56844

PCT Pub. Date: Nov. 11, 1999

(30) Foreign Application Priority Data

May 6, 1998 (GB) ..... 9809527

(51) Int. Cl.[7] ..... A63F 3/00
(52) U.S. Cl. ..... 273/287; 273/447; 273/280
(58) Field of Search ..... 273/287, 447, 273/236, 241, 277, 280, 285

(56) References Cited

U.S. PATENT DOCUMENTS

| | | | | |
|---|---|---|---|---|
| 158,991 | A | * | 1/1875 | Smith |
| 1,617,127 | A | * | 2/1927 | Levay |
| 2,179,471 | A | | 11/1939 | Lee |
| 2,492,462 | A | | 12/1949 | Caesar |
| 2,645,491 | A | | 7/1953 | Volman |
| 3,559,993 | A | | 2/1971 | Thomas |
| 3,583,701 | A | * | 6/1971 | Glass |
| 3,604,705 | A | * | 9/1971 | Hawthrone |
| 3,815,915 | A | | 6/1974 | Chapman |
| 4,261,578 | A | * | 4/1981 | Grottola |
| 4,433,841 | A | * | 2/1984 | Kim |
| 4,964,643 | A | * | 10/1990 | Hass |
| 5,340,105 | A | | 8/1994 | Gostyla |
| 5,882,010 | A | * | 3/1999 | Geror |
| 5,935,045 | A | * | 8/1999 | Lowe |

FOREIGN PATENT DOCUMENTS

| | | |
|---|---|---|
| GB | 593618 | 10/1947 |

* cited by examiner

*Primary Examiner*—Benjamin H. Layno
*Assistant Examiner*—Vishu K Mendiratta
(74) *Attorney, Agent, or Firm*—Jacobson Holman, PLLC

(57) ABSTRACT

A board game including at least one playing surface. The surface is provided with at least one feature adapted in a manner that a participant may cast a suitably sized and shaped projectile around and/or into the feature and wherein the board is adapted to move. The board game is particularly, but not exclusively adapted for use by individuals with limited motor ability for recreation and/or as an educational tool and/or as a therapeutic device.

22 Claims, 5 Drawing Sheets

FIRST PLAYING SURFACE

FIRST PLAYING SURFACE

SECOND PLAYING SURFACE

BOARD GAME

FIELD OF THE INVENTION

The invention relates to an apparatus for playing a board game for use particularly but not exclusively, by more than one player, playing either individually or in teams; furthermore, said apparatus is intended to be used by individuals of any age and/or individuals with limited motor ability for recreation and/or as an educational tool and/or as a therapeutic means.

BACKGROUND OF THE INVENTION

Board games have worldwide popularity and are played by all cultures to assist in recreational activity and education. Typically a board game will comprise a selectively sized and shaped playing surface which provides the means on which the board game is played. Additionally, accessory parts to the board game are provided in the form of counters, instruction cards, die, play figures etc. The playing of the board game is dictated by a set of rules or instructions which refer to the movement, or otherwise, of selected accessory parts around the playing surface. Broard games typically also contain play cards which include instructions, questions, forefits and the like which participants have to complete to progress the game. Board games are traditionally played by more than one person either as a group of individuals or in teams of defined size. Classic board games include Monopoly™, Scrabble™ and Trivial Pursuit™. These board games have universal appeal and can be played by both the relatively young and old alike. Numerous variations of these classical board games exist and even with the advances in computer technology and computer games, they still retain a niche of popularity amongst families and groups inclined to take part in a this form of recreational activity.

Board games do not solely function as an alternative recreational activity. Many board names such as, for example, the above identified games, provide teaching means to improve a child's, numeracy, literacy and general knowledge. Indeed many of these games exist as junior versions of the adult form of the board game, for example, Junior Scrabble™.

Additionally, there is increasing evidence that games may play an important role in the social development of children, promoting team work and communication between children which will serve them in adulthood There is also evidence that game play may also have an important role in physical and mental therapy of all age groups suffering a wide range of physical and mental ailments.

For example, autism is a disease that affects the functioning of the brain resulting in abnormal behaviour patterns, (e.g. those areas of the brain controlling reasoning, social interaction and communication skills is markedly affected in autism suffers). Autistic individuals therefore have difficulties in verbal and non-verbal communication, social interaction, play or leisure activities. Children suffering from autism show, amongst other things, retarded language development. show little interest in making friends and do not initiate spontaneous and/or imaginative and/or pretend play. Current medical opinion is that a cure for autism seems unlikely. Efforts are therefore focused on providing therapy to alleviate the symptoms of autism. Experience has shown that individuals with autism respond well to highly structured and specialised education regimes. This would include some level of communication therapy and social skill development which may be provided on a group basis. The playing of games may be an informal means to promote communication and social interaction thereby improving an individuals social and communicative skills.

Additionally it is become apparent that we are living in an ageing population. Older people (older people refer to those individuals of a pensionable age) are representing a much greater percentage of the population. In the UK there are over 10 million older people which represent approximately 20% of the population. In England in 1996 approximately 250,000 older people were in residential homes (either local authority, voluntary or private) being cared for by care workers. Additionally over 90,000 older people were housed in private retirement homes which provide secure residence and communal activities. It is evident that a significant number of older people are the responsibility of the local authorities which provide both housing, entertainment and medical supervision for their residents.

Further, it is inevitable that, although life expectancy is increasing, chronic diseases of old age still occur, for example and not by way of limitation, rheumatism, arthritis, stroke, neuro degenerative disease, depression, senile dementia, Alzhiemers disease and Parkinson's disease all represent complaints that many older people may experience during old age. Although some medicines exist to alleviate these conditions they still represent a considerable problem to the older person and the carers employed to look after them. Stroke victims, for example, can experience wide ranging symptoms such as paralysis, slurred speech and memory problems. The administration of medicines can help with certain symptoms. However physical therapy also has a role in rehabilitating sufferers of stroke.

It is also becoming apparent that an older person requires mental stimulation to retain mental agility. The majority of a person's life is dedicated to some form of full or part time employment which would ordinarily require some mental activity with respect to completing tasks and problem solving. Those who live alone can join various clubs to maintain friendships and interests and those in residential homes usually have some form of communal meeting place where activities are arranged for those who wish to take part. It is important that these activities provide both enjoyment and mental stimulation if they are to benefit those that take part. Activities such as Bingo and Quiznights although popular can become unexciting and routine if they are the only activities offered.

Accordingly there is a need for games and the like which are designed specifically to achieve the above entertainment, learning and rehabilitation needs.

SUMMARY OF THE INVENTION

We have now suprisingly found an apparatus in the form of a board game which provides a dual function by providing in the first instance a means to test the visual acuity and physical co-ordination of an individual and in the second instance a means to test visual acuity, physical co-ordination and mental agility. It will also be evident that these alternate uses of the apparatus of the invention may be applicable to all age groups and various abilities.

It is an object of the invention to provide a means to encourage interactive behaviour.

It is a further object of the invention to provide a board game that functions as an educational tool.

It is a further object of the invention to provide a board game that promotes physical therapy and/or physical rehabilitation.

It is yet still a further object of the invention to provide a board game that promotes mental agility of individuals.

Accordingly the broadest aspect of the invention there is provided an apparatus for playing a board game comprising: a board adapted to provide at least one playing surface wherein said playing surface is provided with at least one feature adapted in a manner that a participant may cast a suitably sizes and shaped projectile around and/or into the feature; and wherein the board is adapted to move.

According to a first aspect of the invention there is provided an apparatus for playing a board game comprising;

i. a board adapted to provide at least one playing surface wherein said playing surface is provided with at least one feature as hereinbefore defined providing at least one selectively positioned and optionally detachable geometric shape around which and/or into which a participant casts a suitably sized and shaped projectile; and optionally or additionally provides or is adapted so as to provide means to demarcate the playing surface into a selected number of zones which represent an alternative playing surface onto which said projectiles are cast; and ii. associated with or attached to or integral with said board there is provided a pivot or track upon or about which said board is positioned whereby said board may be selectively and optionally rotated or moved.

Preferably the apparatus comprises additionally, iii. a set of game playing cards adapted to dictate selected actions by participants; and/or iv. a set of rules which constitute part of said apparatus which govern the function of said apparatus and the order and actions of each participant using said apparatus.

The apparatus of the invention hereindescribed elegantly provides the means to test both the physical and mental agility of individuals of all ages and abilities.

In a preferred embodiment of the invention said board is characterised by a first and second playing surface wherein said first playing surface is provided with accommodating means comprising at least one uniformally sized recessed portion in the form of a groove, indentation, or receptacle or the like, wherein said recess portion accommodates geometric shapes about which and/or into which participants cast said projectiles; and further, a second playing surface wherein said surface is demarcated into a series of zones which represent the play area onto which said projectiles may be cast by participants.

In yet a further preferred embodiment of the invention said board is selectively sized and shaped. Preferably said board is circular in configuration.

It will be apparent that the size of the board may be selected dependent on its specific use. For example, and not by way of limitation, a large board may be positioned on the floor, or a suitable platform, for example in a nursery, school or communal meeting place in a residential home. Smaller boards may be provided that are suitable for tables or similar support means.

In yet still a further preferred embodiment of the invention said board is constructed of a suitable smooth, robust, rigid, durable, ideally, wipe clean material, which can be readily cleaned with cleaning and/or disinfecting agents. More preferably said board is constructed from wood, perspex, reinforced plastic or the like. More preferably still said board is constructed from Foamtex™.

In yet a further preferred embodiment of the invention said second playing surface is provided with at least one and preferably four zones, each zone demarcated so as to provide four play zones.

In yet a further preferred embodiment of the invention said second playing surface is provided with four play zones, each zone representing a quadrant of said play area ideally each quadrant is of equal area.

In yet still a further preferred embodiment of the invention said second surface is demarcated by the use of selected colouring of said play zones.

In yet still a further preferred embodiment of the invention said board is provided with selectively positioned hinges to facilitate the packaging and/or storage of said board.

In yet still a further preferred embodiment of the invention said hinge is positioned to facilitate the folding of said board into a single quadrant.

In yet a further preferred embodiment of the invention said board is provided with an indicator, mark, arrow or other similar means wherein when board rotation ceases said indicator identifies a selected play zone ideally a quadrant of the playing surface.

In yet a still further preferred embodiment of the invention said indicator is predominantly centrally located and more ideally still is incorporated into the pivot.

In a further preferred embodiment of the invention said geometric shapes can be any uniform shape but preferably spheres, cones, tubes or cubes wherein said geometric shapes are adapted to retain a projectile which is cast around or within the shape. Said geometric shapes may be provided with a cavity into which said projectiles may be cast.

In yet a further preferred embodiment of the invention the placing of said projectile on a selected play zone is indicated by the production of an auditory and/or visual indicator for example a sound and/or a flashing light.

In yet still a further preferred embodiment of the invention said projectiles are suitably sized and shaped to be readily handled by both the young and old. For example, and not by way of limitation, hoops, bean bags, or weighted balls, and can be relatively easily cast by participants.

In yet a further preferred embodiment of the invention said projectiles are constructed from any durable, robust material which can be easily cleaned and/or disinfected, for example natural or synthetic materials, preferably leather, rubber, plastics or the like.

In yet a further preferred embodiment of the invention there is provided a series of sets of play cards.

The apparatus comprises a selectively sized and shaped board supported on a centrally located pivot about which the playing surface can optionally rotate. One side of the board is provided with indentations into which can be secured a number of selectively sized geometric shapes. Participants using this playing surface of the board game can acquire points by throwing hoops or similar projectiles over and/or into the secured objects as the board rotates. Alternatively the board can be stationary. The reverse side of the board provides an alternate playing surface and is divided into a selected number of areas demarcated from one another by their colour. The participants throw a suitably shaped projectile onto the rotating playing surface and, depending on which area of the playing surface the projectile lands, the participant has to either answer a selected question, score points or alternatively complete a forfeit.

According to a second aspect of the invention there is provided an apparatus for playing a board game or a component thereof as substantially herein described and/or with reference to the corresponding figures.

According to a third aspect of the invention there is provided an apparatus as hereinbefore defined for use in encouraging interactive behaviour, as an educational tool, promoting physical and/or rehabilitation and/or mental agility.

BRIEF DESCRIPTION OF THE DRAWING

The apparatus of the invention will now be described by way of example only with reference to the following figures wherein.

DETAILED DESCRIPTION OF THE PREFERRED EMBODIMENTS

Figure 1A:
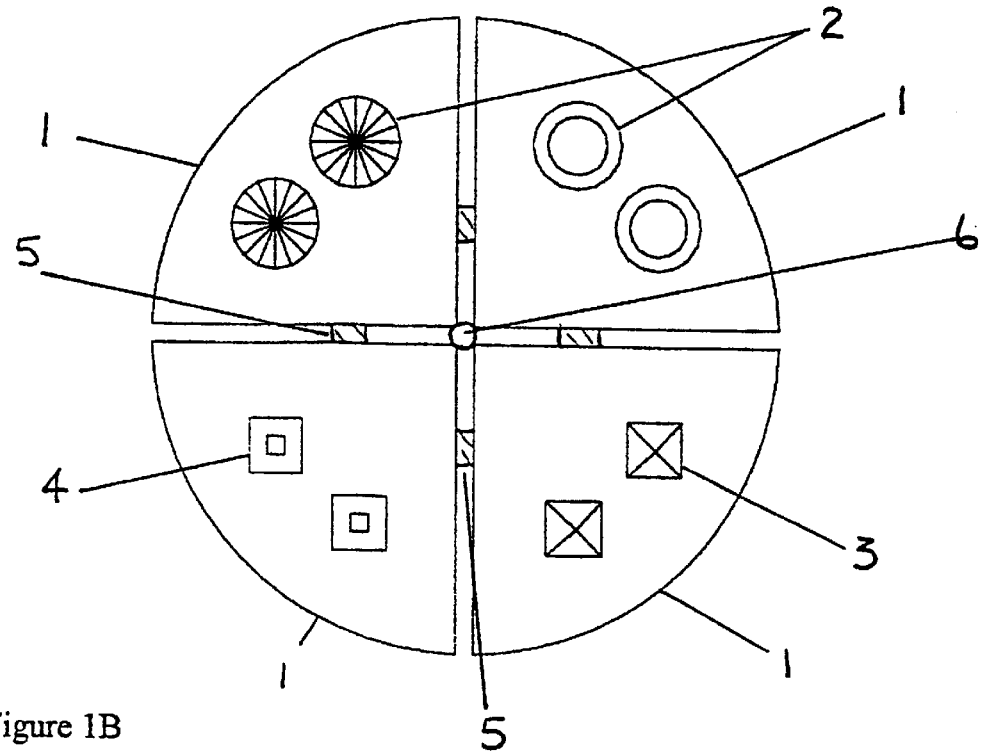
FIG. 1A represents a plan view of the first playing surface in a fully opened position.

Referring to FIG. 1A, a plan view of the first playing surface in a fully opened position. The circular board is divided into equal quadrants (1). Each quadrant is provided with recessed accommodation means (2, 3, 4) suitably sized and shaped so as to provide secure support for selected geometric shapes. The centrally located pivot (6) supports the board a selected distance above a resting surface whereby rotation is facilitated when manual force is applied.

Selectively positioned hinges (5) are shown which facilitate the folding of the board and enable the storage and/or transport of the board when not in use.

Figure 1B:
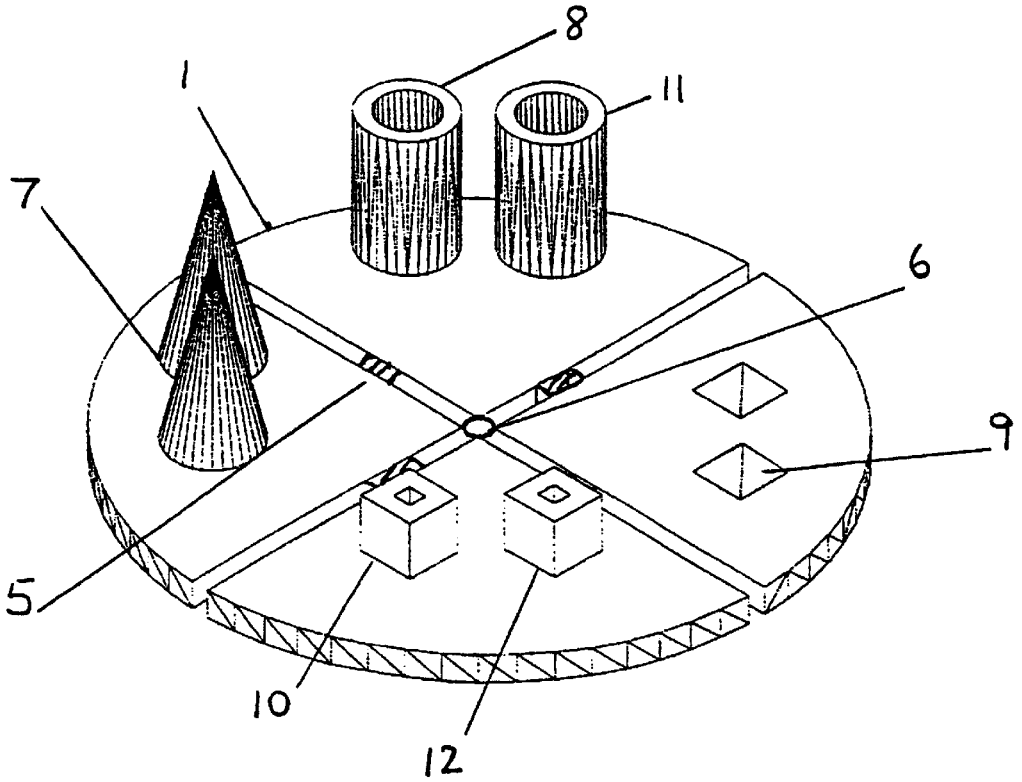
FIG. 1B represents a front perspective of the first playing surface including various geometric shapes in place on the upper surface.

Referring to FIG. 1B there is shown a front perspective view of the first playing surface with attached geometric shapes. The embodiment shown in FIG. 1B represents the use of alternative geometric shapes. These may be solid cones (7) solid tubes (8), solid pyramids (9), solid cubes (10) or alternatively, open tubes (11) or open hollow cubes (12).

Figure 2A:
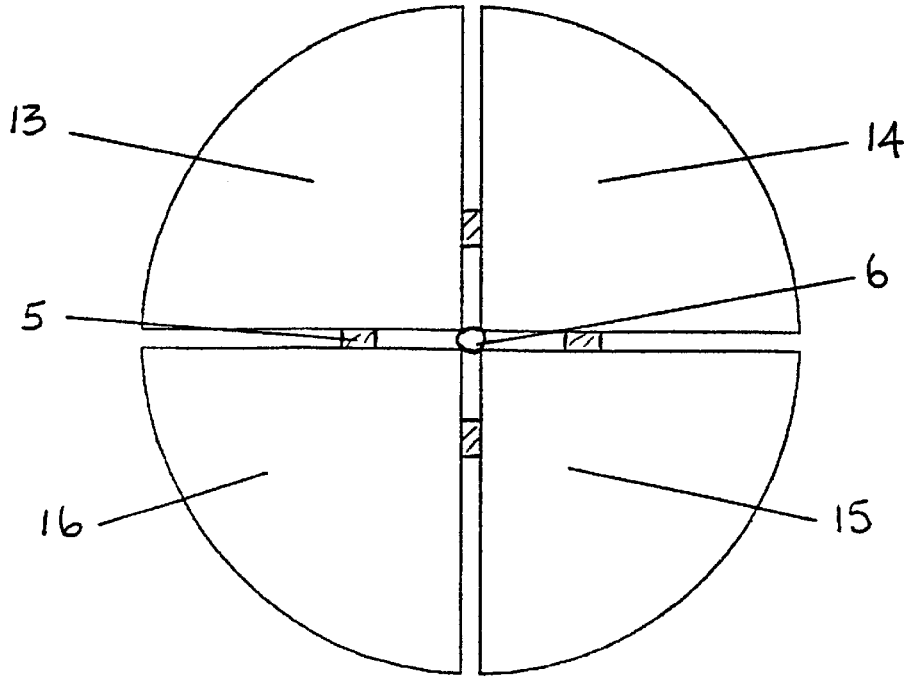
FIG. 2A represents a plan view of the second playing surface in a fully opened position.
Figure 2B:
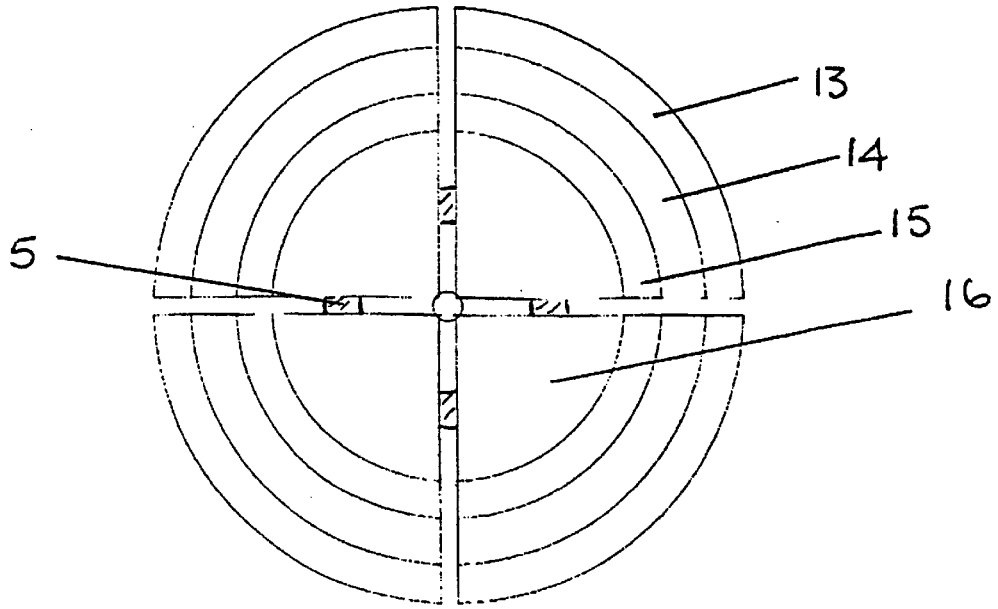
FIG. 2B represents an alternative embodiment of FIG. 2A.

Referring to FIG. 2A a plan view second playing surface in a fully opened position. In this particular embodiment of the apparatus, the board is divided into quadrants, each quadrant is demarcated by a distinct colour, for example, blue (13), yellow (14), red (15) or green (16). The quadrants represent four play zones. FIG. 2B represents an alternate configuration of the second playing surface. In this alternate embodiment the play zones are demarcated as alternatively coloured concentric circles, each coloured differently to distinguish each circle (13, 14, 15, 16).

Figure 3:
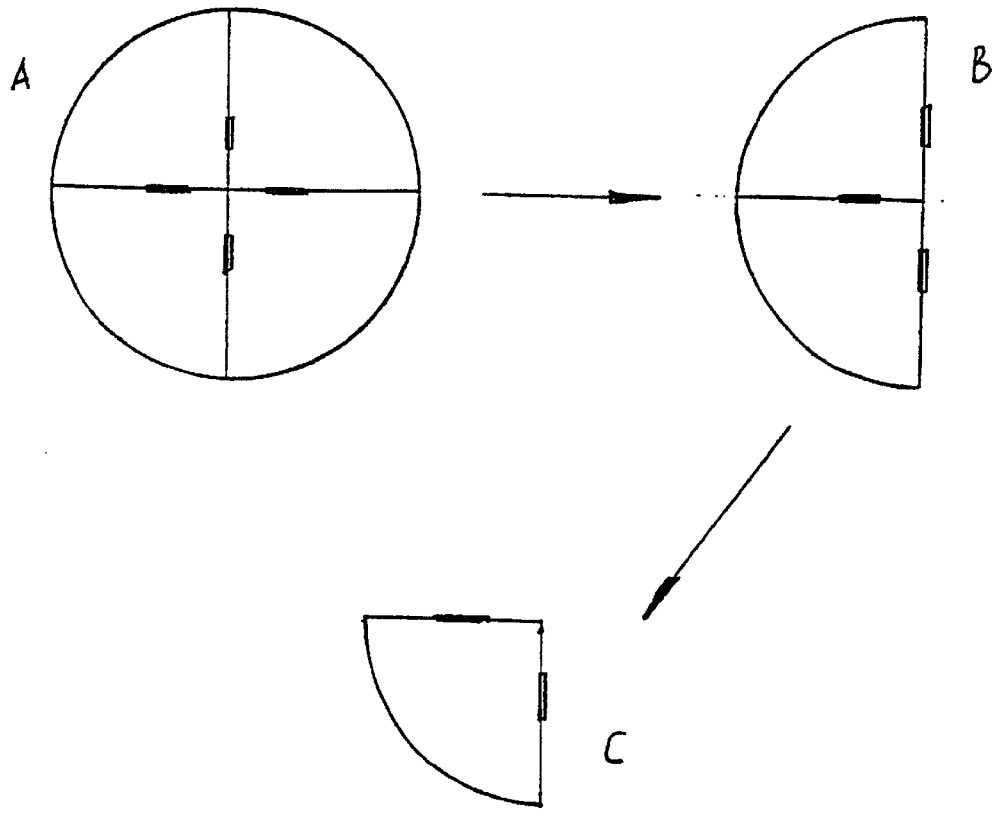
FIG. 3 represents of the folding procedure of the game board.

FIG. 3 represents the folding procedure of the board for storage and/or transport purposes. (A) represents a fully opened position of the second playing surface; (B) represents folding of the board into a semi-circle before completing the compaction to a single quadrant of the board (C).

Figure 4:
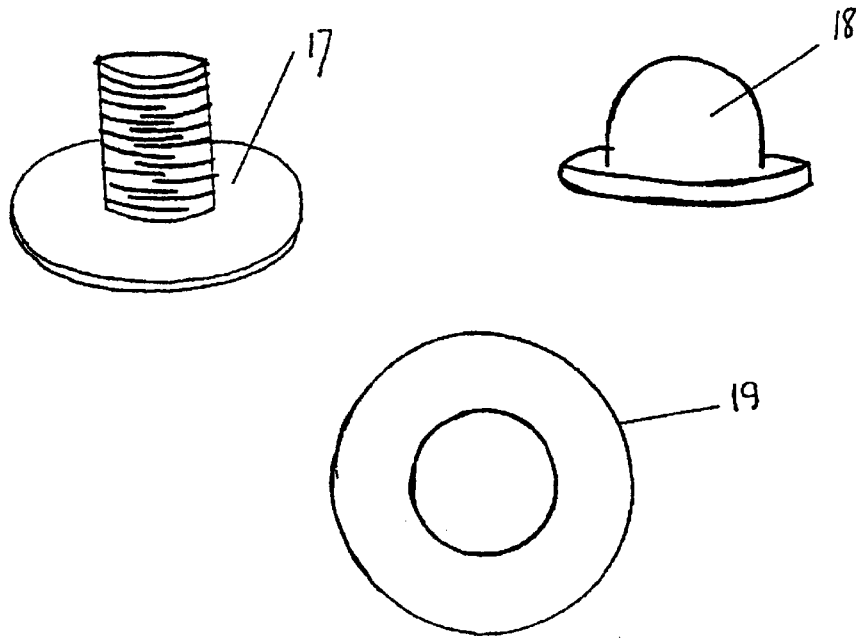
FIG. 4 represents a front perspective view of the board game supporting pivot, including domed attachment nut and corresponding washer.

Referring to FIG. 4 there is shown a front perspective view of the threaded pivot (17), a fixing nut (18) and a washer (19). In use the pivot (17) passes through a centrally located hole in the board and a domed fixing nut (18) is threaded onto the pivot portion that projects above the board surface so as to securely position the board thereabout and inverted provides a domed surface so as to facilitate rotation of the board on or about a playing surface when force is imparted to the board.

Figure 5:
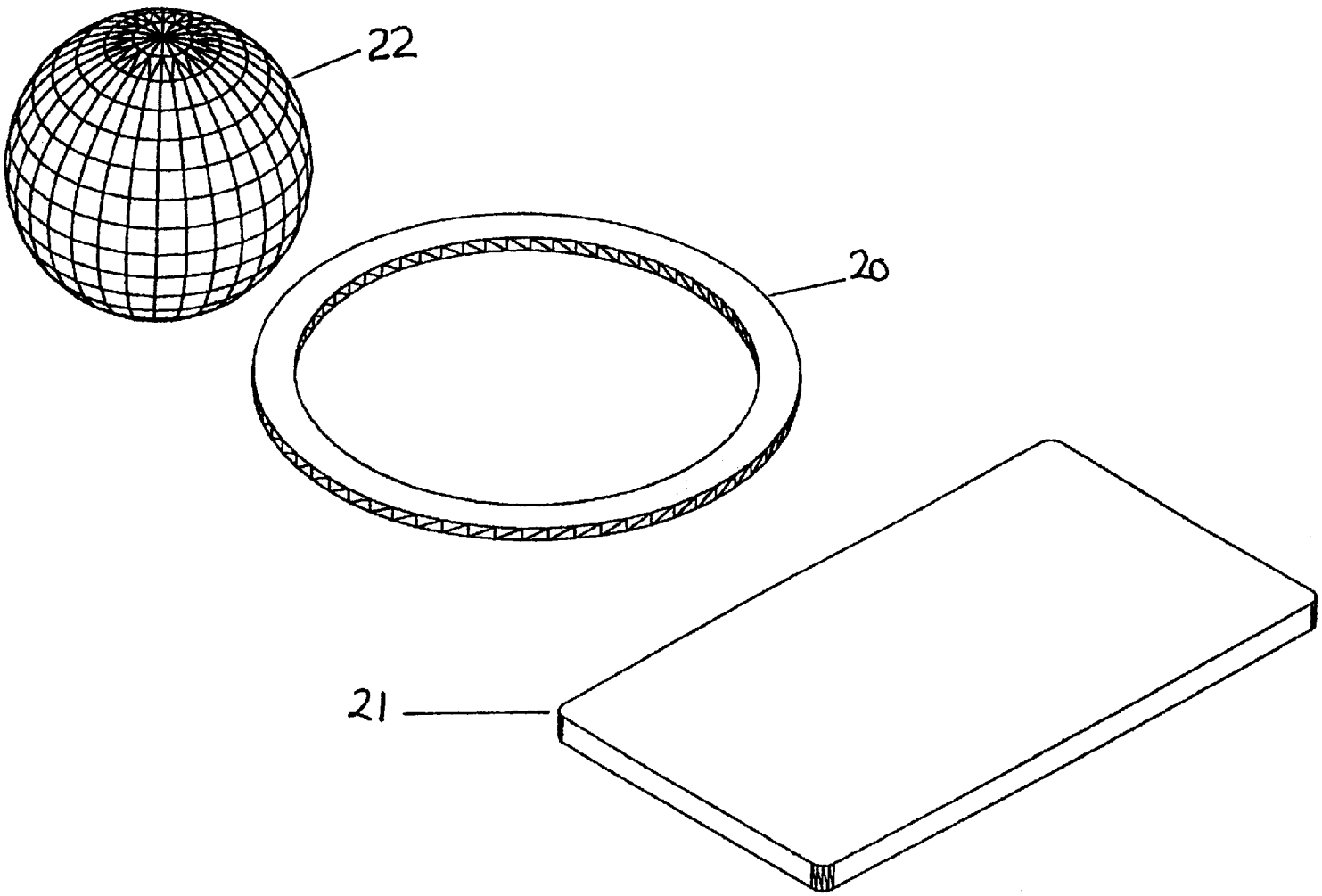
FIG. 5 represents alternate preferred projectiles for use by participants.

FIG. 5 is a diagramatic representation of alternate forms of projectiles: a hoop (20), a bean bag (21) and a ball (22). The hoop is manufactured from any durable robust material and is such that it can be easily cleaned and/or disinfected. The bean bags are manufactured from fabric or similar material (e.g. plastic, leather) and adapted, by the provision of a zip, push-action stud, Velcro™ or any alternate fixing means, so that the contents of the bag can be replaced and the bag washed by conventional means. The ball (22) can be constructed from any suitable material, for example leather or plastic.

Having illustrated the component parts of the board, including accessory parts, the playing of the board game using alternate playing surfaces will now be exemplified by reference to those parts hereindescribed.

Using the first playing surface, visual acuity and co-ordination are required to participate in this embodiment of the board game. Participants, either individuals or members of a team are provided with projectiles, for example, a hoop (20), bean bag (21) or ball (22). Each participant is positioned at a selected distance from the board and is challenged to cast a selected projectile at one of the geometric shapes (7, 8, 9, 10, 11, 12) secured on the first surface of said board. The objective is to place the hoop about, for example, a cone (7), or a pyramid (9), or a tube (8), or a cube (10). Each successful placement is rewarded by the acquisition of points with respect to the degree of difficulty associated with the placement. The degree of difficulty may also be varied by using either using a rotating board or a stationery board at the time of casting the projectile. The speed of rotation may also be varied so as to increase or decrease the degree of difficulty. Alternatively bean bags may be used in the aforedescribed manner and points gained by placing the bean bags in the cavities provided by the tubes (11) and/or open hollow cubes (12).

It will be apparent that this embodiment of the board game tests eye to hand co-ordination and may promote this faculty in the young and in those that for various reasons (i.e. injury or disease) have poor co-ordination which can be improved by practice.

In an alternative embodiment of the invention the second playing surface is used. The second playing surface is divided into quadrants, each distinctly coloured. Participants, either individuals or members of a team are provided with projectiles, for example a bean bag, and participants are placed at a selected distance from the board. The participants are challenged to cast the bean bag towards the playing surface so as to place the bean bag on either a designated colour, or alternatively, randomly on one of the four representative colours. Depending on the location of the bean bag on the playing surface the participant is challenged to, for example, answer a selected question from a set of cards.

The cards may be grouped by subject, for example, and not by way of limitation, general knowledge, sport, cinema, television, gardening or the like. Alternatively each card may contain a pictorial representation. For example and not by way of limitation, a comparison can be made between a pictorial image and a comparable image which has been amended to delete certain items present in the original image. The task for the participant is to identify these changes in a defined time period. Alternatively a comparison may be made between two pictorial images which have qualitative differences between them. The participant is challenged to identify these differences in a defined period of time.

Alternatively the pictorial image may contain individual representatives of a specific occupation and/or profession and the participant is challenged to identify the occupation.

Alternatively cards may request the participant to list a defined number of a particular set. For example, and not by way of limitation, name five of the Apostles, name five parts of a church, name eight cities beginning with a defined letter, name eight English cheeses, name ten gemstones, name ten spices, etc.

Alternatively the cards may request the participant to perform a selected action. For example and not by way of limitation, skip around the room. Sing a song, hop on one leg, touch your toes and so on. Thus the apparatus of the invention can be used to encourage further physical activity.

Figure 6:
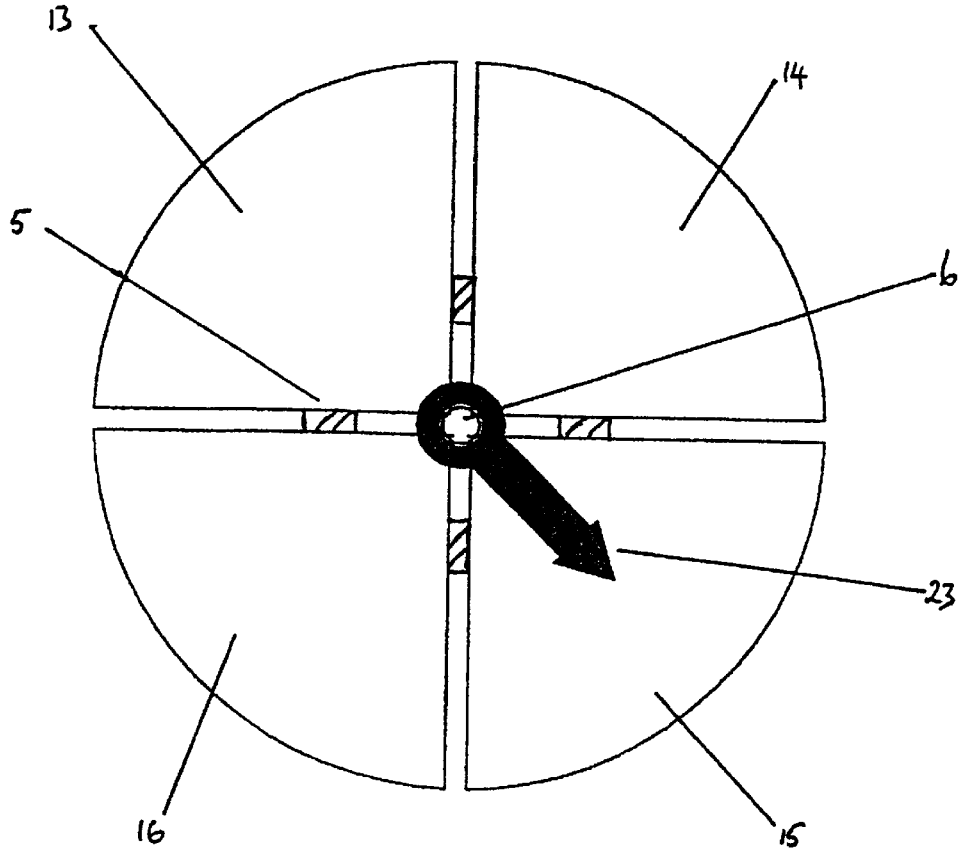
FIG. 6 represents a front perspective view of an alternate embodiment of the board game which includes a centrally located arrow.

FIG. 6 represents a front perspective view of an alternate embodiment of the board game in which the centrally located pivot is additionally provided with an indicator or mark, for example an arrow (23), which is loosely connected to the pivot(6) to allow the arrow to rotate when force is applied to the arrow (23). The colour or quadrant on which the arrow stops determines the type of question and/or task to be completed by the participant(s). Alternatively the board is provided with a fixed indicator or mark and, upon rotation of the board, the colour on which the indicator stops when the board ceases to rotate determines which type of question and/or task is to be completed by the participant(s).

It will be evident that the degree of difficulty of the task set on the cards can be varied according to the age and/or mental and/or physical ability of the participant. It will be apparent therefore that these embodiments of the game can apply to children of nursery age and to older people as well as those individuals that may be undergoing therapy to help with a physical condition and/or rehabilitation from the effects of a specific disease or injury.

In a further aspect of the invention there is provided the use of the apparatus as hereinbefore defined in a number of activities, a set of rules for use with the apparatus of the invention as hereinbefore defined, or a set of game playing cards for use with the apparatus of the invention as hereinbefore defined. The uses, rules and cards sets representing further aspects of the invention are illustrated in non-limiting manner with reference to the following.

What is claimed is:

1. An apparatus for playing a board game comprising:

i) a board adapted to provide at least one playing surface wherein a first playing surface is provided with at least one feature providing at least one selectively positioned geometric shape around which a participant may cast a suitably sized and shaped projectile; and ii) associated with said board there is provided one of a pivot and a track for movement of said board, said board including means to demarcate a second playing surface into a selected number of zones which represent a play area onto which a participant may cast a suitably sized and shaped projectile, said board being provided with an indicator wherein when board rotation ceases said indicator identifies a selected play zone.

2. An apparatus according to claim 1 wherein said at least one geometric shape is provided with a cavity into which a participant may cast the suitably sized and shaped projectile.

3. An apparatus according to claim 1 wherein said board is at least one of rotatable about an axis substantially perpendicular to the plane of the board and moveable in a plane containing the plane of the board by means of the one of the pivot and the track.

4. An apparatus according to claim 1 which additionally comprises at least one of i) a set of game playing cards adapted to dictate selected actions by participants; and ii) a set of rules which constitute part of said apparatus which govern the function of said apparatus and the order and actions of each participant using said apparatus.

5. An apparatus according to claim 1 wherein the at least one geometric shape is detachable from the playing surface.

6. An apparatus according to claim 5 wherein said first playing surface is provided with accommodating means comprising at least one uniformly sized recessed portion in the form of a groove, an indentation, and receptable wherein said recessed portion accommodates said at least one detachable geometric shape.

7. An apparatus according to claim 6 wherein said board is circular in configuration.

8. An apparatus according to claim 6 wherein said board is constructed of a suitable smooth, robust, rigid, durable, wipe clean material which can be readily cleaned with at least one of cleaning and disinfecting agents.

9. An apparatus according to claim 8 wherein said board is constructed from wood, perspex, reinforced plastic.

10. An apparatus according to claim 1 wherein said second playing surface is provided with four playzones, each zone representing a quadrant of said play area.

11. An apparatus according to claim 10 wherein said quadrants are of equal area.

12. An apparatus according claim 1 wherein said second surface is demarcated by the use of selected colouring of said play zones.

13. An apparatus according to claim 1 wherein said indicator is centrally located.

14. An apparatus according to claim 1 wherein the placing of the projectile on a selected play zone is indicated by the production of at least one of an auditory and a visual indicator.

15. An apparatus according to claim 14 wherein said indicator is at least one of a sound and a flashing light.

16. An apparatus according to claim 1 wherein said board is provided with selectively positioned hinges to facilitate at least one packaging and storage of said board.

17. An apparatus according to claim 16 wherein said hinges are positioned to facilitate the folding of said board into a single quadrant.

18. An apparatus according to claim 1 wherein said geometric shapes are one of spheres, cones, tubes and cubes.

19. An apparatus according to claim 1 comprising projectiles which are sized and shaped to be readily handled by both the young and old.

20. An apparatus according to claim 19 wherein said projectiles are selected from any durable, robust material which is at least one of easily cleaned and easily disinfected.

21. An apparatus according to claim 1 wherein said apparatus is provided with a series of sets of playing cards.

22. An apparatus for playing a board game according to claim 1 for use in encouraging interactive behavior as at least one of an educational tool, promoting physical rehabilitation and mental agility.

* * * * *